US007261232B2

(12) United States Patent
Schropp

(10) Patent No.: US 7,261,232 B2
(45) Date of Patent: Aug. 28, 2007

(54) FOLDED BOX

(76) Inventor: Joachim Schropp, Rosenstrasse 14, 74831 Gundelsheim (DE)

( * ) Notice: Subject to any disclaimer, the term of this patent is extended or adjusted under 35 U.S.C. 154(b) by 456 days.

(21) Appl. No.: 10/476,111

(22) PCT Filed: Apr. 30, 2002

(86) PCT No.: PCT/EP02/04732

§ 371 (c)(1),
(2), (4) Date: Oct. 24, 2003

(87) PCT Pub. No.: WO02/087979

PCT Pub. Date: Nov. 7, 2002

(65) Prior Publication Data

US 2004/0129766 A1 Jul. 8, 2004

(30) Foreign Application Priority Data

Apr. 30, 2001 (DE) ..... 101 21 899

(51) Int. Cl.
*B65D 5/08* (2006.01)
*B65D 5/36* (2006.01)
*B65D 5/74* (2006.01)

(52) U.S. Cl. ..... 229/117.01; 229/116.1; 229/125.42; 229/137

(58) Field of Classification Search ..... 229/103.2, 229/110, 116.1, 117.01, 117.05, 117.06, 125.42, 229/137; 206/424; D9/430–433, 713
See application file for complete search history.

(56) References Cited

U.S. PATENT DOCUMENTS 2,050,894 A * 8/1936 Paige ..... 229/116.1
2,067,998 A * 1/1937 Williamson ..... 229/116.1
2,553,513 A 5/1951 Denison et al.
2,936,940 A 5/1960 Berghgracht
3,084,843 A * 4/1963 Urban ..... 229/103.2
3,203,618 A * 8/1965 Andrews et al. ..... 229/103.2
3,369,727 A * 2/1968 Wright ..... 229/116.1
3,402,875 A 9/1968 Palmer
3,411,691 A * 11/1968 Whitaker et al. ..... 229/117.01
4,313,556 A * 2/1982 Boyle et al. ..... 229/116.1
4,362,245 A 12/1982 Kuchenbecker
5,094,385 A * 3/1992 Antczak et al. ..... 229/110
5,312,035 A 5/1994 Nold et al.
5,660,322 A * 8/1997 Jensen ..... 229/103.2
5,738,272 A 4/1998 Anchor et al.
6,027,016 A * 2/2000 Ljungstrom et al. ..... 229/116.1

FOREIGN PATENT DOCUMENTS

CA 2 390 816 4/2001
DE 1 820 241 10/1960
DE 1 976 542 1/1968
DE 1 761 225 4/1968

(Continued)

*Primary Examiner*—Gary E. Elkins
(74) *Attorney, Agent, or Firm*—Walter A. Hackler

(57) ABSTRACT

The invention relates to a folded box comprising two principal wall sections (5, 9), which are joined on one side and can be interconnected on the opposing side, for example by means of a flap (39), to form a substantially tubular body, whose ends can be sealed. To reduce production costs, a lateral wall section (11, 12), with ends that taper to a point, is configured in at least one of the two principal wall sections (5, 9).

19 Claims, 11 Drawing Sheets

FOREIGN PATENT DOCUMENTS

| | | | | | |
|---|---|---|---|---|---|
| DE | 3 844 110 C1 | | 8/1990 | | |
| EP | 0 438 735 A1 | | 12/1990 | | |
| EP | 0 936 150 A1 | | 8/1999 | | |
| EP | 1 043 237 | | 10/2000 | | |
| GB | 2229710 A | * | 3/1990 | ..... | 206/424 |
| WO | WO 01/23260 A1 | | 4/2000 | | |

* cited by examiner

FOLDED BOX

BACKGROUND OF THE INVENTION

The invention concerns a folded box, in particular of carton, comprising two principal wall sections which are connected to each other on one side, in particular through a principal folding line, and can be connected to each other on the opposite side e.g. by a flap, to form a substantially tubular body whose ends can be closed. The invention also concerns a folded box of a one-piece blank.

Conventional cushioned packages have closing sections which can be folded on top of each other to close the cushioned package. The closing sections of cushioned packages simultaneously serve to shape and keep the shape of the substantially tubular body. The closing sections of cushioned packages are e.g. elliptical. The non-rectangular contour of the closing sections prevents use of a rectangular blank for cushioned packages. For production, an intermediate section is therefore required between two blanks. The non-rectangular contour of the closing sections of cushioned packages increases the material consumption since the material between the closing sections of two different blanks must be removed. Moreover, closing of the cushioned packages by hand is relatively demanding since the closing sections must be folded successively against each other. Moreover, cushioned packages cannot be closed in a fluid-tight fashion through welding or sealing.

It is therefore the underlying purpose of the invention to provide a blank, which can be produced in an easy and inexpensive fashion, for a folded box which can be closed by hand. A further object of the invention consists in providing a folded box of a one-piece blank of simple construction which can be produced in an inexpensive fashion. The inventive folded box shall be easy to close manually and also by a machine.

SUMMARY OF THE INVENTION

This object is achieved in a one-piece, in particular, rectangular blank for a folded box, in particular of carton, comprising two main wall sections which are connected to each other on one side, in particular by a principal folding line and can be connected to each other on the opposite side e.g. by a flap to form a substantially tubular body, whose ends can be closed, in that in at least one of the two principal wail sections, a side wall section with tapering ends is formed. The side wall section gives the tubular body a stable spatial shape.

A preferred embodiment of the blank is characterized in that the side wall section is formed by two folding lines which are separated from each other in the center and merge into each other at the ends. The folding lines provide the tubular body with a polygonal cross-section. Usually, two side wall sections are disposed opposite to each other to provide the tubular body with a rectangular cross-section in the center.

A further preferred embodiment of the blank is characterized in that the two folding lines forming the side wall section are disposed parallel to each other in the central region, which gives the tubular body a the shape of a right parallelepiped in the central region.

A further preferred embodiment of the blank is characterized in that the side wall section has triangular ends providing the cross-section of the tubular body with particular stability.

A further preferred embodiment of the blank is characterized in that the side wall section has the shape of an ellipse which provides the folded box produced from the blank with an optically pleasant shape. The cross-section of the tubular body decreases from the center to the outside.

A further preferred embodiment of the blank is characterized in that the principal wall sections on the tapering ends of the side wall section merge into closing sections. The closing sections abut each other when the folded box is assembled. This greatly facilitates closing of the folded box by hand and by machine.

A further preferred embodiment of the blank is characterized in that closure folding lines are formed between the principal sections and the closing sections. The closure folding lines permit surface abutment of the closing sections providing fluid-tight closure of the folded box.

A further preferred embodiment of the blank is characterized in that the closure folding lines are disposed substantially transversely to the at least one side wall section and the distance between the closure folding lines and the associated edge of the respective closing section is not constant but varies. This ensures safe closure of a package produced from the blank.

A further preferred embodiment of the blank is characterized in that a side wall section with tapering ends is formed in both principal wall sections and that a continuous folding line is disposed between and substantially parallel to the side wall sections. The continuous folding line ensures folding of the tubular body for storage or transport. The continuous folding line also facilitates machine production on conventional gluing machines and facilitates insertion of products.

A further preferred embodiment of the blank is characterized in that the distance between the closure folding lines and the associated edge of the respective closing section increases starting from the side wall sections to the inside and to the outside. Abutting closing sections are thereby held together in the erected state of the folded box. The course of the closure folding lines produces tension in the erected folded box which keeps the folded box closed.

A further preferred embodiment of the blank is characterized in that the distance between the closure folding lines and the associated edge of the respective closing section increases linearly starting from the side wall sections to the inside and to the outside. The resulting straight closure folding lines are advantageous in that they are easy to produce.

A further preferred embodiment of the blank is characterized in that the closure folding lines are curved to the inside like a circular arc, relative to the blank. Experiments carried out within the scope of the present invention showed that a slightly curved shape of the closure folding lines is particularly advantageous. The curvature of the closure folding lines ensures that the closing sections snap in when a folded box produced from the blank, is closed.

A further preferred embodiment of the blank is characterized in that the distance between the closure folding lines and the associated edge of the respective closing section is constant in the region within the two side wall sections and increases to the outside in the regions outside of the two side wall sections. The closing sections are thereby pretensioned in the closing direction in the assembled state of the folded box. Pretensioning ensures snapping in or convergence of the closing sections when the folded box is closed.

A further preferred embodiment of the blank is characterized in that on the side, opposite to the continuous folding line, of one of the side wall sections, a flap is formed on the associated principal wall section by a further folding line which is disposed parallel to the continuous folding line. The flap servers to connect the two wall sections to each other.

A further preferred embodiment of the blank is characterized in that the continuous folding line and the further folding line substantially coincide when the folded box is assembled. This ensures folding of the blank even when the two wall sections are connected to each other on two sides to form the tubular body.

A further preferred embodiment of the blank is characterized in that an outlet funnel is provided on one of the tapering ends of the side wall section. The outlet funnel serves for pouring out a fluid located in the closed folded box. The outlet funnel may, of course, also be used for filling in a fluid depending on size and shape.

A further preferred embodiment of the blank is characterized in that the outlet funnel is formed by means of five outlet funnel folding lines which are formed on the tapering end of the side wall section. The five folding lines ensure repeated opening and closing of the outlet funnel when the folded box is erected.

A further preferred embodiment of the blank is characterized in that the distance between the outlet funnel folding lines from each other decreases to the associated tapering end of the side wall section which guarantees funnel-shaped widening of the outlet funnel to the outside.

A further preferred embodiment of the blank is characterized in that a triangular projection with tip pointing to the outside is disposed in the region of the outlet funnel on the two associated closing sections. The triangular projection ensures, in connection with a centrally disposed outlet funnel folding line, precise pouring out.

A further preferred embodiment of the blank is characterized in that a closing flap is provided on the outside of the outlet funnel which can be separated from the two bordering closing sections by at least one perforation line. The closing flap serves to keep the outlet funnel closed. When the closing flap is removed, the outlet funnel can be opened.

The above-stated object is achieved in a folded box of a one-piece blank, in that the folded box has one body in the assembled state which tapers to the outside with two ends and has a substantially rectangular cross-section in the center. The shape of the folded box therefore resembles a plastic bag welded at the ends. A plastic bag obtains its shape by the solid content. The shape of the inventive folded box is determined by the folding lines. The inventive folded box is advantageous in that it can be supplied in a flat state. Moreover, it has its own body whose size and shape are determined without product, and a functioning closing unit. It can be erected manually and also by a machine. The inventive blank can be processed on conventional production machines without additional equipment. The folded boxes can be produced in many variants, e.g. as carrier package or with particular features such as closing means and tearing techniques.

A preferred embodiment of the folded box is characterized in that the body has two outwardly tapering side wall sections. The side wall sections provide the erected folded box with stability. Shaping of the side wall sections provides the erected folded box with e.g. the shape of a right parallelepiped with two opposite tapering ends.

A further preferred embodiment of the folded box is characterized in that two flat closing regions are formed on the outwardly tapering ends of the body. The flat closing regions permit fluid-tight closure of the folded box e.g. by welding. The closing regions also permit manual closure and re-opening of the folded box. The specific arrangement of the closure folding lines ensures snapping in and holding together of the closure regions without having to use other techniques or auxiliary means. The closing regions may also be sealed or glued.

A further preferred embodiment of the folded box is characterized in that the principal and side wall sections are mutually separated from each other only by a folding line. This single folding line between each principal wall section and the joining side wall section provides the erected folded box with its defined shape.

A further preferred embodiment of the folded box is characterized in that a cut is provided in at least one of the closing sections into which a flap can engage which is formed on the closing section which abuts the closing section with the cut when the folded box is erected. The flap and the cut facilitate closing of the erected folded box. When the flap engages in the associated cut, the two abutting closing sections are fixed relative to each other.

This closing mechanism is advantageous in that it is easy to realize since no additional fastening means are required and repeated opening and closing of the folded box is ensured.

A further preferred embodiment of the folded box is characterized in that the cut has the shape of a circular arc which is curved inwardly relative to the blank. This shape of the cut has proven to be particularly advantageous in practice.

A further preferred embodiment of the folded box is characterized in that the flap is formed by a cut which has the shape of a circular arc which is curved inwardly relative to the blank. This shape of the cuts ensures simple closing of the folded box when it is erected.

A further preferred embodiment of the folded box is characterized in that in at least one closing section at least one flap is formed which abuts on an adhesive surface, formed on an abutting closing section and covered by the flap, when the folded box is erected. As long as the foldable flap abuts the adhesive surface, the associated closing sections also abut each other and the folded box is closed. When the flap is folded, the connection to the closing section with adhesive surface is released and the abutting closing sections can be removed from each other.

A further preferred embodiment of the folded box is characterized in that the adhesive surface is delimited by a groove. The groove extends preferably only in an upper layer of the blank. The groove ensures defined pulling out of the upper blank layer which provides on the one hand that the original seal cannot be reproduced. On the other hand, the outer side of the closing section provided with the adhesive surface remains untouched also after removal of the upper blank layer, i.e. the optical impression is not impaired.

One substantial advantage of the inventive folded box consists in that a one-piece, square blank can be used. This permits production of folded boxes without new technical equipment. The simple and quick closing of the folded box due to the distance between the closure folding lines and the associated edge of the closing sections ensures that the folded box can be made flat again after use.

In the flat state, the folded box can either be supplied to a recycling cycle or be manually or mechanically erected again. The possibility of welding or sealing the closing sections of the folded box is important in particular for food and in general for powdery and liquid products. The closing sections can also be formed as handles or have a so-called Euro hole.

Due to the particularly simple handling, the inventive folded box is particularly well suited as gift wrapping, e.g. for dessous, accessories or jewellery. The folded box is also suitable for accommodating sweets, household goods, office equipment or food. Since the folded box can be tightly sealed, it is also suited to accommodate powder and liquids. The inventive folded box finally has a particularly pleasant design when it is erected. The pleasant design and the flatly tapering closing flaps make the folded box suitable also for display in a decoration wall.

In the embodiment with the slightly curved closure folding lines, a tension is generated which ensures snapping in of the closing sections when the folded box is manually closed. The outlet funnel integrated in the closing sections can be closed again after opening thereby protecting the content of the folded box from vermins and dirt also after opening and handling is moreover facilitated.

The inventive blank can be provided with pre-glued points or be printed or punched by a machine and erected on a machine. In the latter case, the folding lines can also be eliminated. The package becomes more stable thereby and the package has no disturbing lines. The closing region can be displaced depending on the optics of the printed image.

Further advantages, features and details of the invention can be extracted from the following description which describes in detail different embodiments with reference to the drawing. The features mentioned in the claims and in the description may be essential to the invention either individually or collectively in arbitrary combination.

DESCRIPTION OF THE PREFERRED EMBODIMENT

Figure 1:
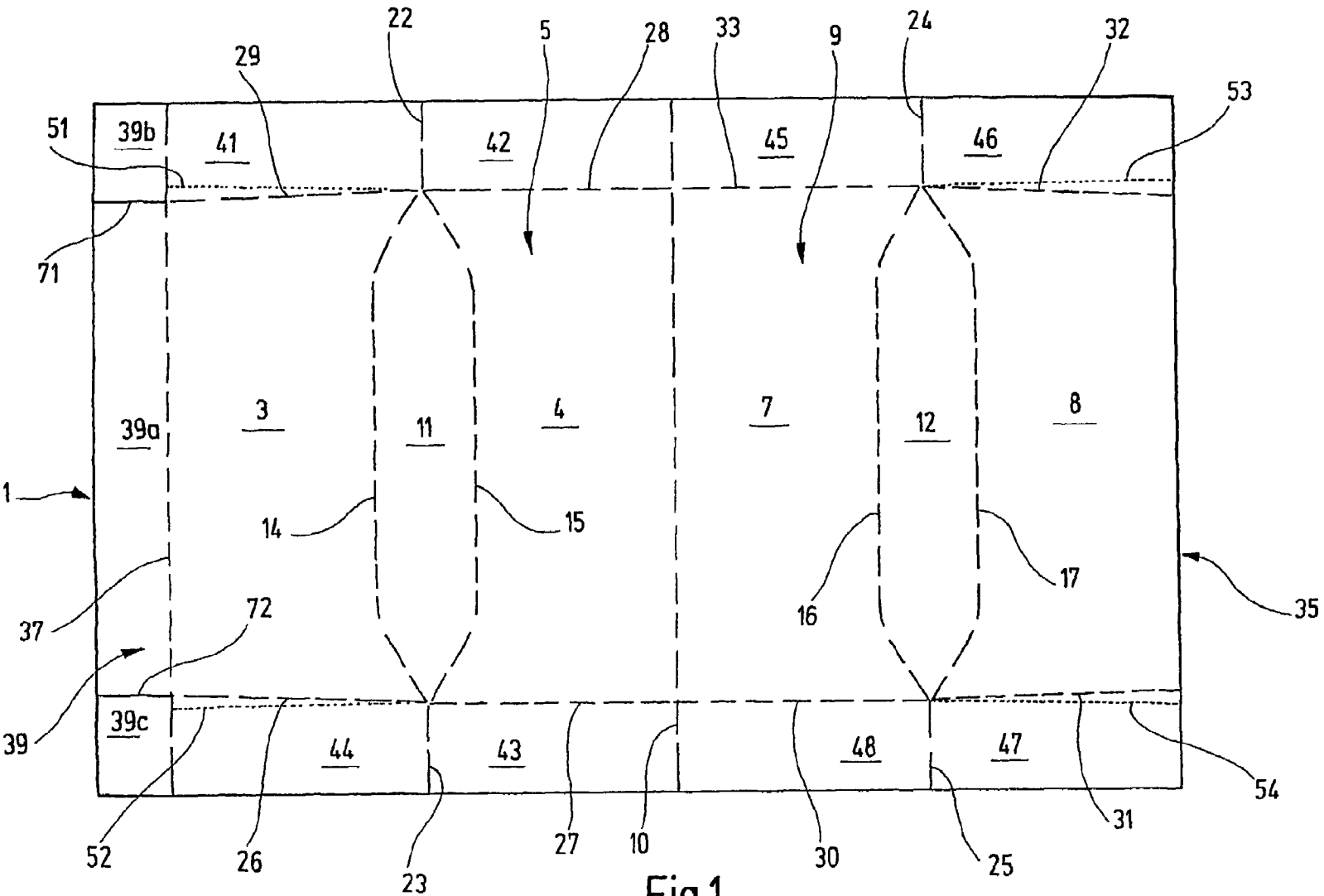
FIG. 1 shows a top view onto a blank for a folded box according to a first embodiment.

FIG. 1 shows a top view of a rectangular blank 1. A plurality of folding lines is disposed on the blank 1. The folding lines may be folds, grooves, scratches or perforations. The folding lines form defined sections when the blank 1 is erected to a folded box.

The blank 1 comprises a principal section 5 having two partial sections 3 and 4, and a principal section 9 having two partial sections 7 and 8. The principal sections 5 and 9 are separated from each other by a principal folding line 10. The principal sections 5 and 9 have the shape of rectangles abutting each other along their longitudinal sides.

The side wall section 11 is formed by two side wall folding lines 14 and 15 which extend parallel to each other in the central region and taper towards each other at the ends. At the tapering ends, the side wall folding lines 14 and 15 merge into terminating folding lines 22 and 23. The side wall section 12 is delimited in the same fashion by two side wall folding lines 16 and 17 which extend parallel to each other in the center and merge at the end into terminating folding lines 24 and 25.

The side wall section 11 is disposed between the partial sections 3 and 4 of the principal section 5. The side wall section 12 is disposed between the partial sections 7 and 8 of the principal section 9. The partial section 3 is delimited at two opposite sides by two closure folding lines 26 and 29. The partial section 4 is delimited on two opposite sides by two closure folding lines 27 and 28. The partial section 7 is delimited on two opposite sides by two closure folding lines 30 and 33. The partial section 8 is delimited on two opposite sides by two closure folding lines 31 and 32.

The partial section 8 is also delimited by the side wall folding line 17, the closure folding lines 31, 32 and a terminating edge 35 of the blank 1. The partial section 7 is delimited by the principal folding line 10, the closure folding lines 30, 33 and the side wall folding line 16. The partial section 4 is delimited by the principal folding line 10, the closure folding lines 27, 28 and the side wall folding line 15. The partial section 3 is delimited by the side wall folding line 14, the closure folding lines 26, 29 and a terminating folding line 37.

The terminating folding line 37 delimits a flap 39 on the side facing away from the partial section 3. The flap 39 is divided by perpendicular cuts 71 and 72 into three flap sections 39*a*, 39*b* and 39*c*. The flap 39 serves to connect the principal sections 5 and 9 to each other. When the principal sections 5 and 9 are connected to each other through the flap 39, the terminating edge 35 of the blank 1 abuts the terminating folding line 37 thereby providing the blank 1 with a tubular shape when it is erected.

Eight closing sections 41, 42, 45, 46 and 44, 43, 48, 47 are formed on the longitudinal sides of the blank 1. The closing sections 41 to 44 are formed on the principal section 5 and the closing sections 45 to 47 are formed on the principal section 9. The closing section 41 is delimited by the longitudinal edge of the blank 1, the terminating folding line 37, the closure folding line 29 and the terminating folding line 22.

The closing section 42 is delimited by the longitudinal edge of the blank 1, the terminating folding line 22, the closure folding line 28 and the principal folding line 10. The closing section 43 is delimited by a longitudinal edge of the blank 1, the terminating folding line 23, the closure folding line 27 and the principal folding line 10. The closing section 44 is delimited by the longitudinal edge of the blank 1, the terminating folding line 23, the closure folding line 26 and the terminating folding line 37.

The closure section 45 is delimited by a longitudinal edge of the blank 1, the principal folding line 10, the closure folding line 33 and the terminating folding line 24. The closing section 46 is delimited by the longitudinal edge of the blank 1, the terminating folding line 24, the closure folding line 32 and the terminating edge 35 of the blank 1. The closure section 47 is delimited by a longitudinal edge of the blank 1, the terminating folding line 25, the closure folding line 31 and the terminating edge 35 of the blank 1. The closing section 48 is delimited by the longitudinal edge of the blank 1, the principal folding line 10, the closure folding line 30 and the terminating folding line 25.

The closure folding lines 27, 30 and 28, 33 extend parallel to the longitudinal edges of the blank 1. The closure folding lines 26, 29 and 31, 32 extend non-parallel to the longitudinal edges of the blank 1. Dotted lines 51, 52, 53 and 54 indicate that the distance between the closure folding lines 26, 29 and 31, 32 and the associated longitudinal edges of the blank 1 increases slightly providing snapping in of the abutting closing section when the folded box is closed. Moreover, the abutting closing sections are held in abutment when the folded box is closed.

For assembling the inventive folded box, the flap 39 formed on the principal section 5 is glued to the principal section 9 such that the terminating edge 35 coincides with the terminating folding line 37 which produces a flat configuration which can be erected to a tubular body with rectangular cross-section.

When the folded box is erected, the side wall sections 11 and 12 produce a rectangular cross-section in the center of the folded box. When the folded box is erected, the closing sections 41 and 42, 43 and 44, 45 and 46, 47 and 48 abut each other. The folded box can be closed with two fingers pressing together the closing sections in the region of the terminating folding lines 22, 24 and 23, 25.

In the closed state, the abutting closing sections can be welded, glued or fastened to each other in another fashion. The inventive design of the closure folding lines 26, 29, 31 and 32 does not necessarily require mounting of the abutting closing sections to each other since the abutting closing sections are held together by the inventive design of the closure folding lines 26, 29, 31 and 32. When the abutting closing sections are not mounted to each other, the erected folded box can be easily opened by moving apart the abutting closing sections. The folded box can be easily collapsed again.

In the embodiment shown in FIG. 1, the side wall folding lines 14, 15 and 16, 17 of the side wall sections 11 and 12 extend largely parallel to each other. The side wall folding lines 14 and 15, 16 and 17 meet only at the ends of the side wall sections 11 and 12.

Figure 2:
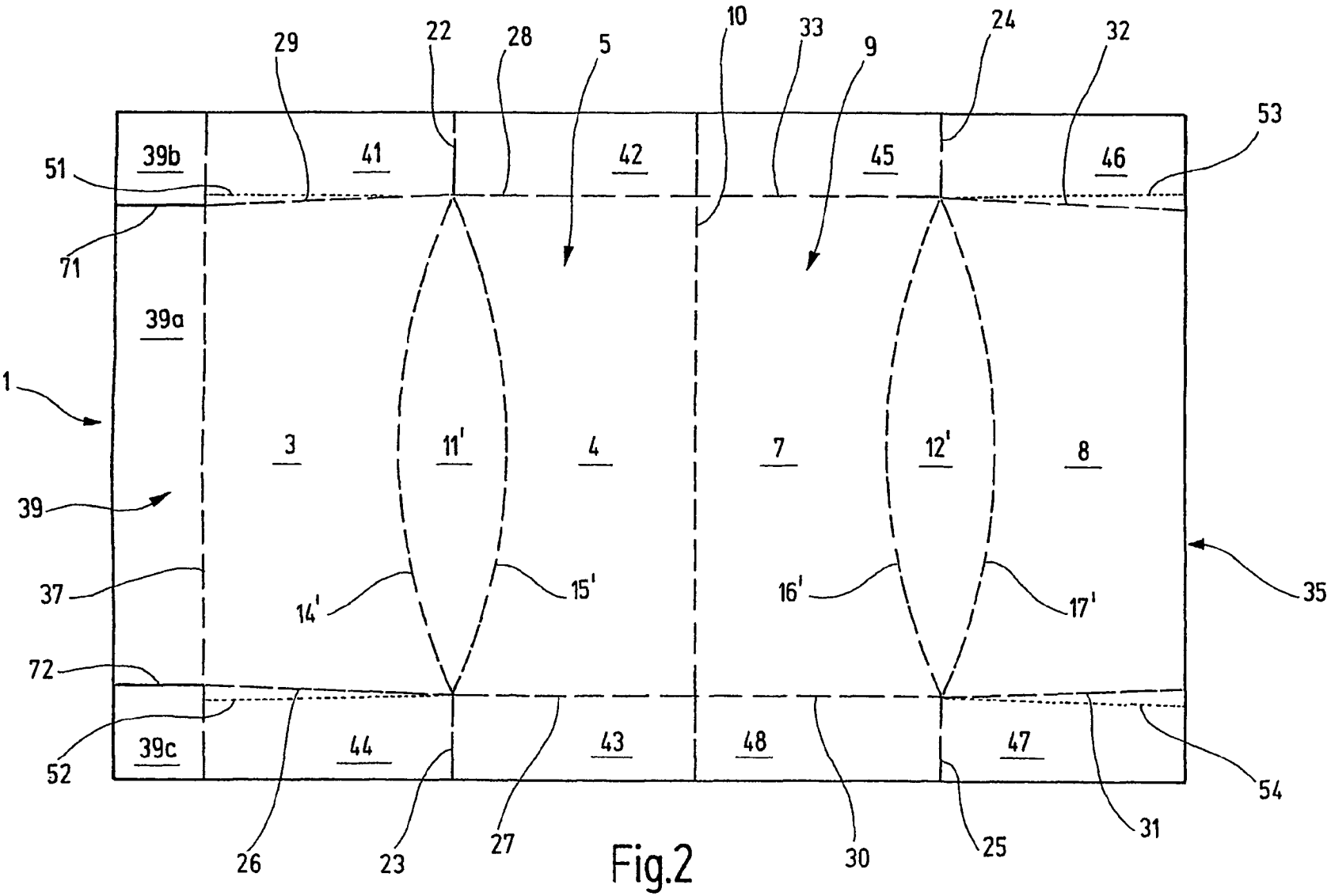
FIG. 2 shows a top view onto a blank for a folded box according to a second embodiment with elliptical side wall sections.
Figure 3:
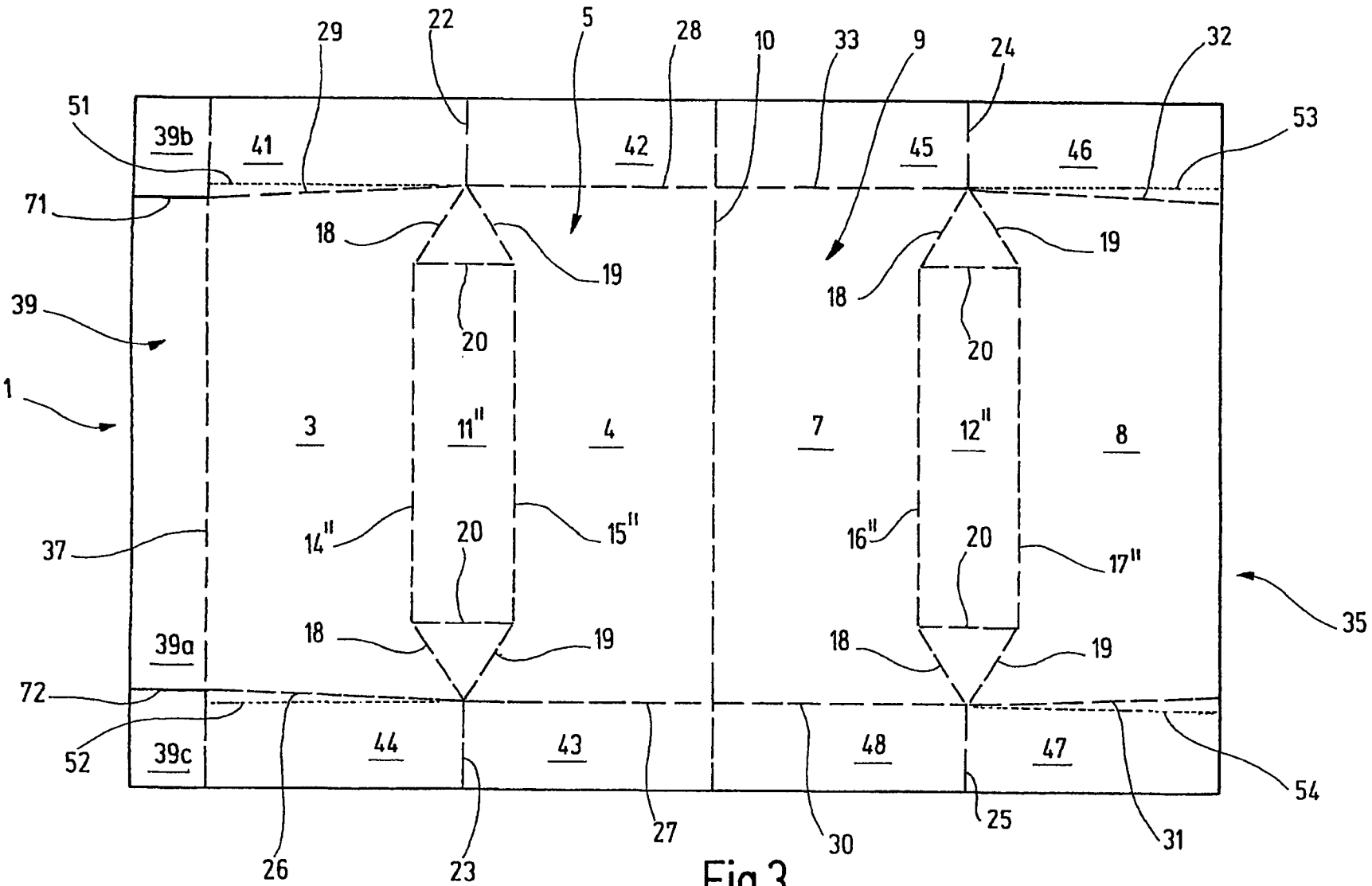
FIG. 3 shows a top view onto a blank for a folded box according to a third embodiment.

The embodiments shown in FIGS. 2 and 3 resemble the embodiment shown in FIG. 1. Identical parts have identical reference numerals such that reference is made to FIG. 1. Below, only the differences between the individual embodiments are mentioned.

In the embodiment of the blank 1 shown in FIG. 2, the side wall folding lines 14', 15' and 16', 17' which form the side wall sections 11' and 12' are not disposed parallel to each other but elliptical. The erected folded box therefore has an elliptical cross-section between abutting closing sections.

In the embodiment of the blank 1 shown in FIG. 3, the side wall folding lines 14", 15" and 16", 17" of the side wall sections 11" and 12" are disposed parallel to each other and form one rectangle each with two folding lines 20. Two folding lines 18 and 19 extend from the points of intersection between the folding lines 20 and the side wall folding lines 14", 15" and 16", 17" to the terminating folding lines 22 to 25. The folding lines 18, 19 and 20 each form a triangle at the end of the side wall sections 11 and 12. The tips of the triangles extend to the outside. The terminating folding lines 22 to 25 extend from the tips of the triangles.

In all three embodiments shown in FIGS. 1 to 3, five folding lines each intersect or meet at the tips of the tapering side wall sections 11 and 12. This is an essential feature of the present invention. This feature obtains that the inventive folded box can be erected and collapsed again in a simple fashion.

In the embodiments shown in FIGS. 1 and 2, firstly the folding lines 14, 15, 28, 22 and 29, secondly the folding lines 14, 15, 26, 23 and 43, thirdly the folding lines 16, 17, 31, 25 and 30 and fourthly the folding lines 16, 17, 32, 24 and 33 merge in one point. In the embodiment shown in FIG. 3, firstly the folding lines 18, 19, 28, 22 and 29, secondly the folding lines 18, 19, 27, 23 and 26, thirdly the folding lines 18, 19, 31, 25 and 30 and fourthly the folding lines 18, 19, 32, 24 and 33 merge in one point.

Figure 4:
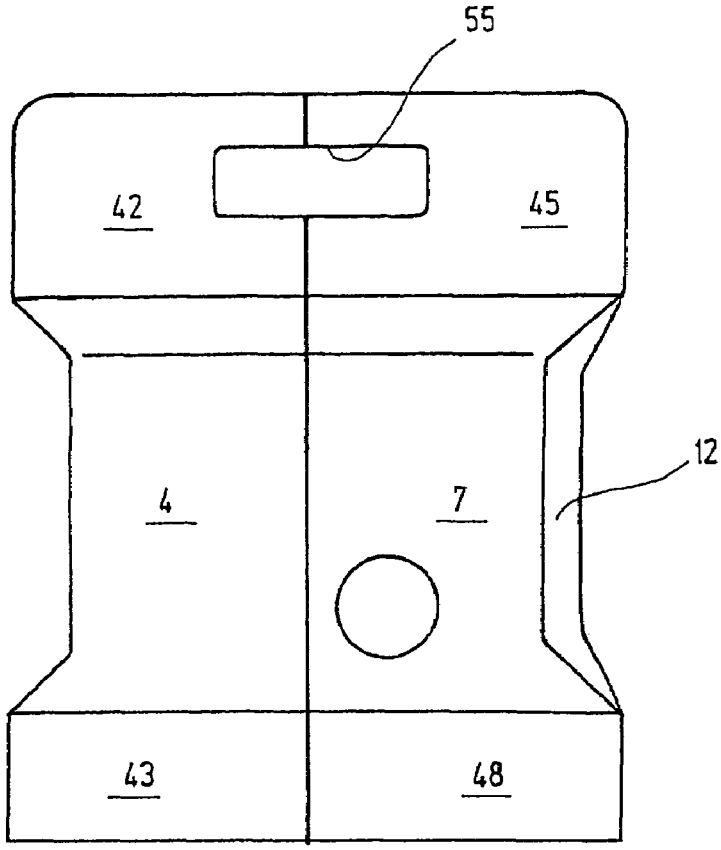
FIG. 4 shows a perspective view of an erected folded box with handle and a window.

FIG. 4 shows a perspective view of an erected folded box in accordance with a fourth embodiment. As shown in FIG. 4 the partial sections 4 and 7 can be connected to each other in one piece in machine blanks without forming a folding line between them. The same is true for the closing sections 42 and 45. A common opening 55 is formed in the closing sections 42 and 45 which serves as handle. The opening 55 may also have the shape of a Euro hole on which the erected folded boxes can be hung.

Figure 5:
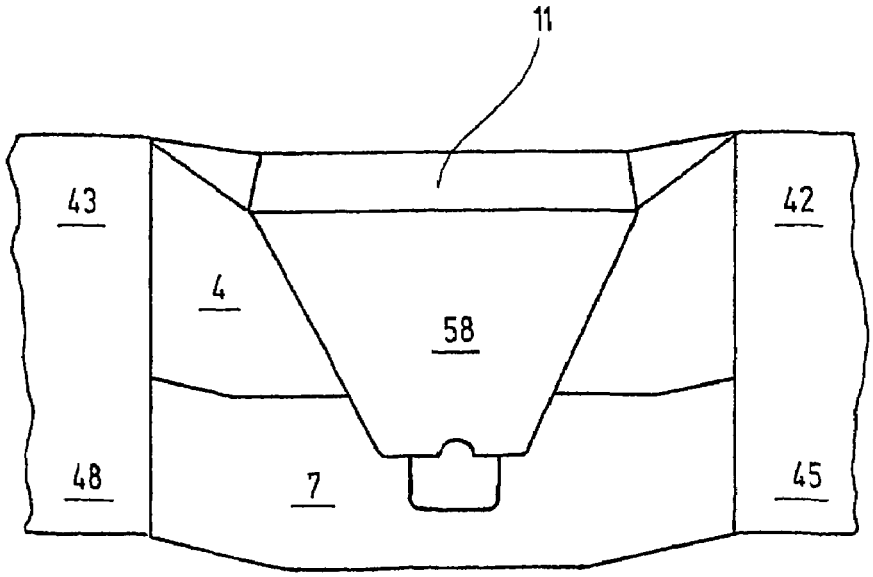
FIG. 5 shows a perspective view of an erected folded box with reclosable opening flap.

The embodiment shown in FIG. 5 has an opening which can be re-sealed by an opening flap 58. The opening provides access to the erected folded box from the outside without having to open the closing sections 42, 45 or 43, 48.

Figure 6:
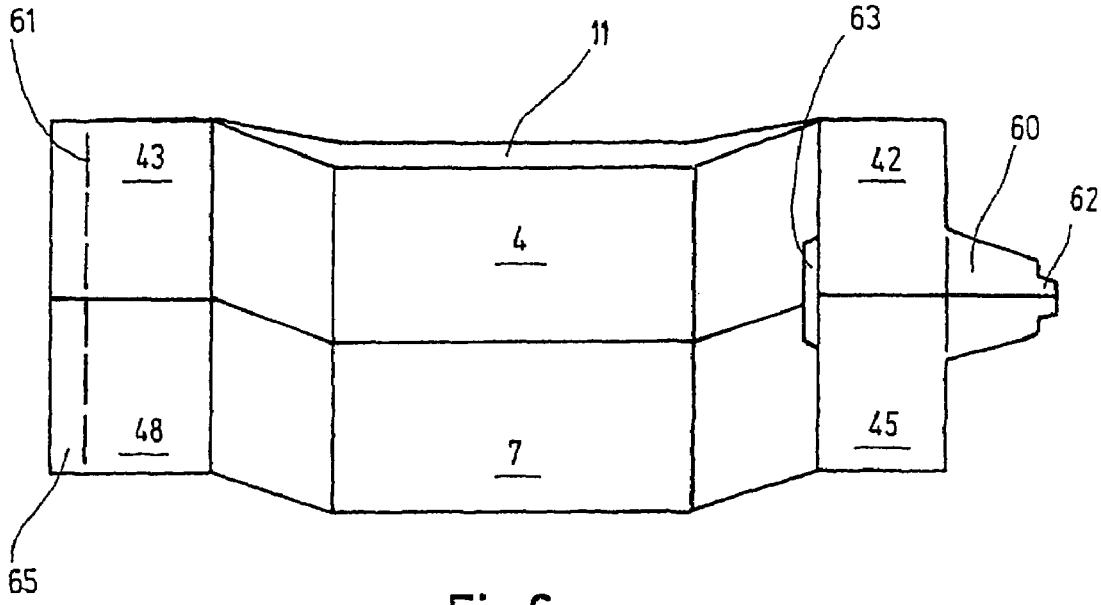
FIG. 6 shows a perspective view of an erected folded box with flap closure.

In the embodiment shown in FIG. 6, the closing sections 42 and 45 are held in abutment on the associated closing sections by a locking flap 60. When closing, the locking flap 60 is folded from the position shown in FIG. 6 such that a projection 62 formed in the locking flap 60 at the end engages in a recess 63. At the end of the closing sections 43 and 48, a perforation line 61 is provided for opening the folded box. The perforation line 61 is formed between the closing sections 43, 48 and a section 65 in which the abutting closing sections are glued to each other. The folded box can be opened by tearing or cutting off the section 65.

Figure 7:
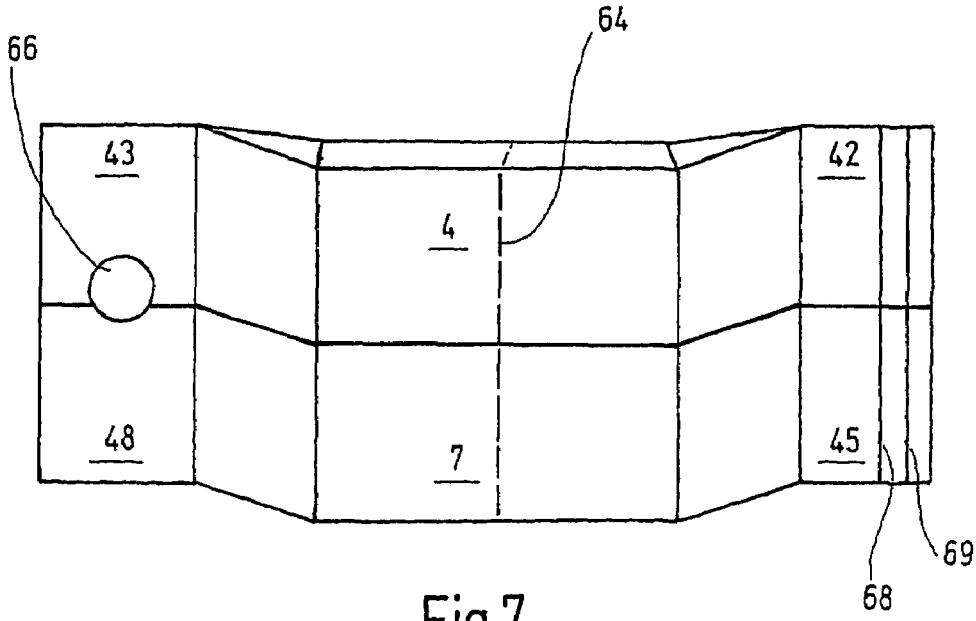
FIG. 7 shows a perspective view of an erected folded box with a breaking line in the center.

In the embodiment of FIG. 7, the center of the erected folded box has a perforation line 64 which serves as breaking line for opening the folded box. The closing sections 43 and 48 are held in abutment on their associated closing sections by a circular punching 66. The closing sections 42 and 45 are held in abutment on their associated closing sections by grooves 68 and 69. It is of course also possible to combine different types of closure.

Figure 8:
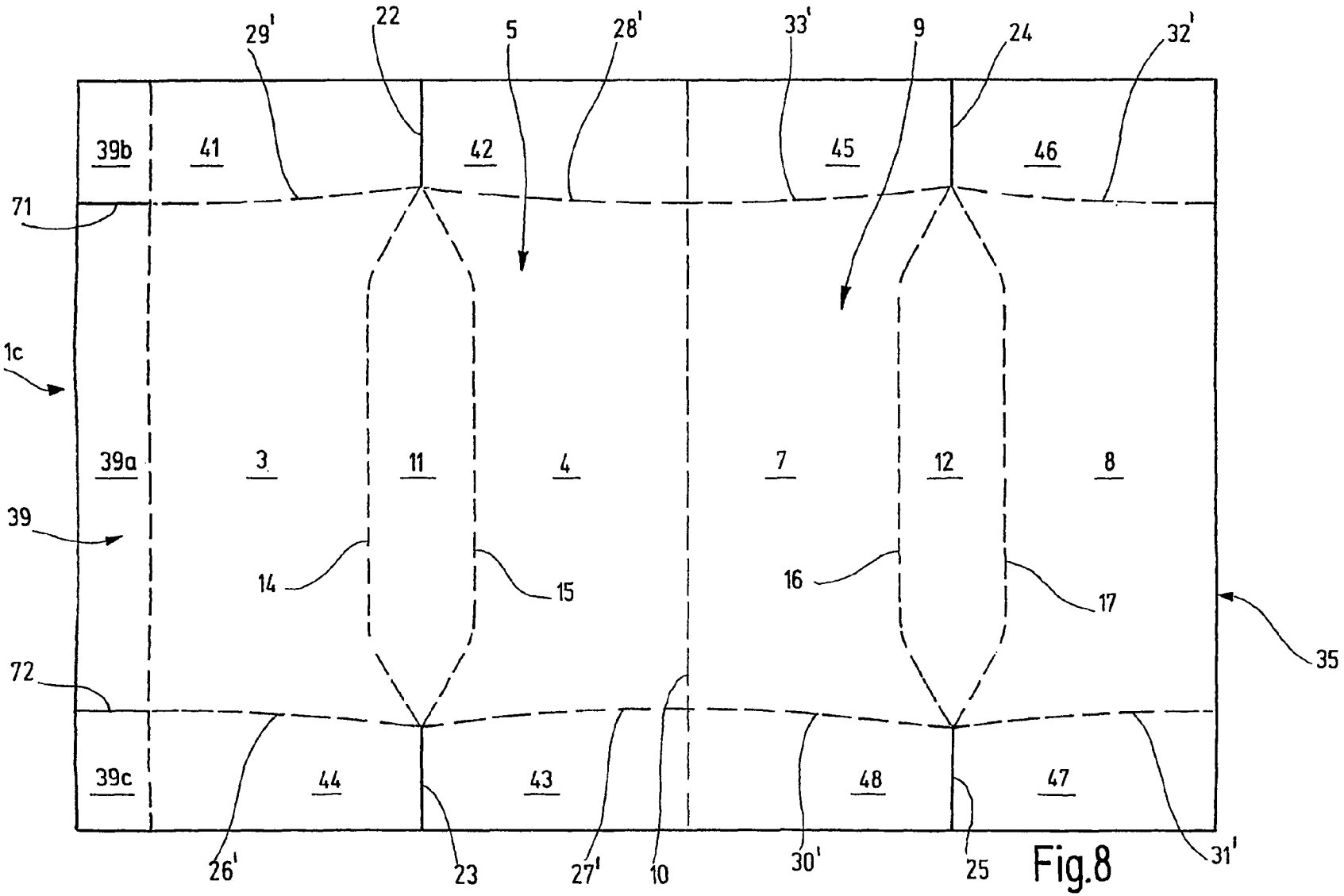
FIG. 8 shows a top view onto a blank for a folded box according to a fourth embodiment with circular arc-shaped curved closure folding lines.
Figure 9:
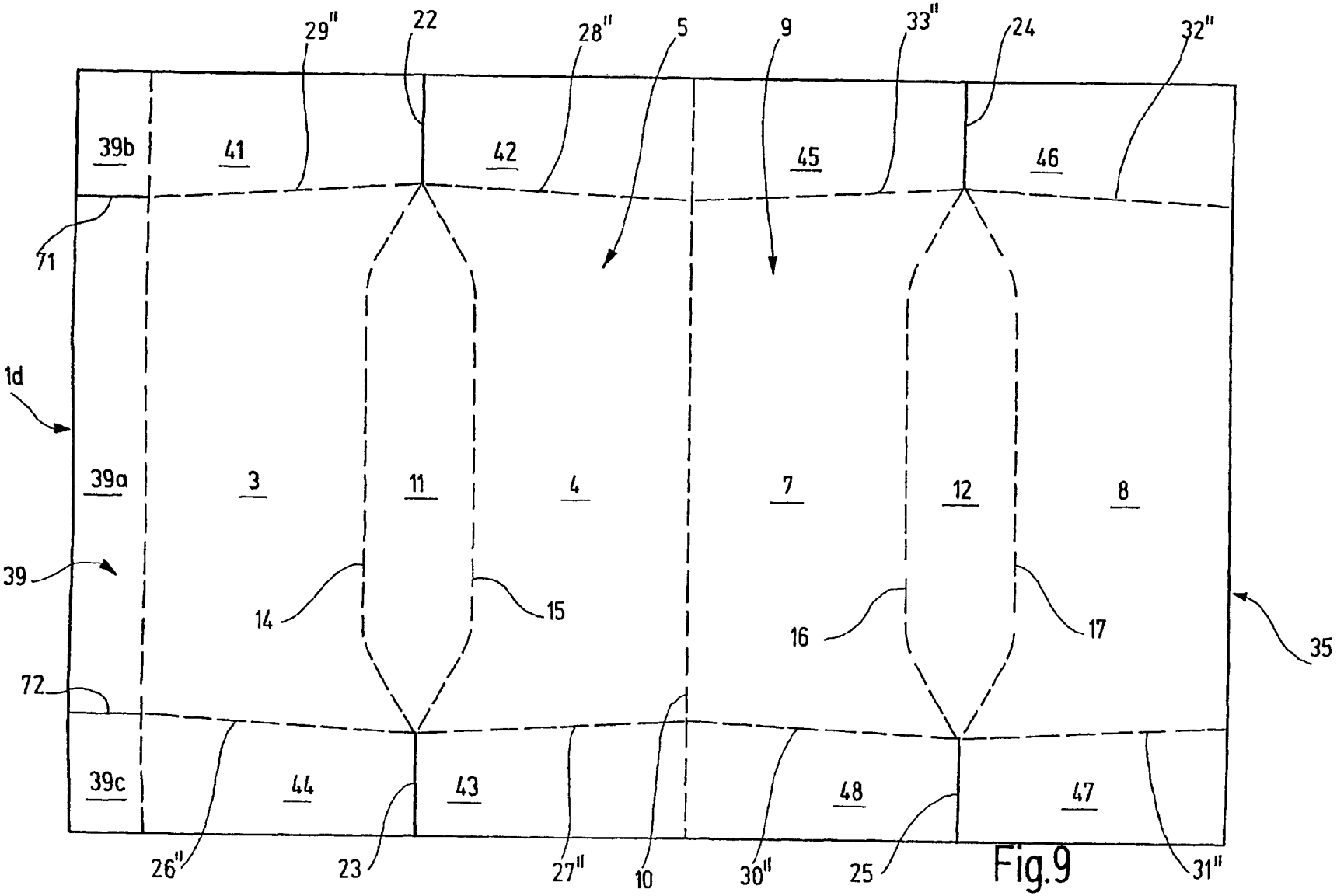
FIG. 9 shows a top view onto a blank for a folded box according to a fifth embodiment with straight folding lines.
Figure 10:
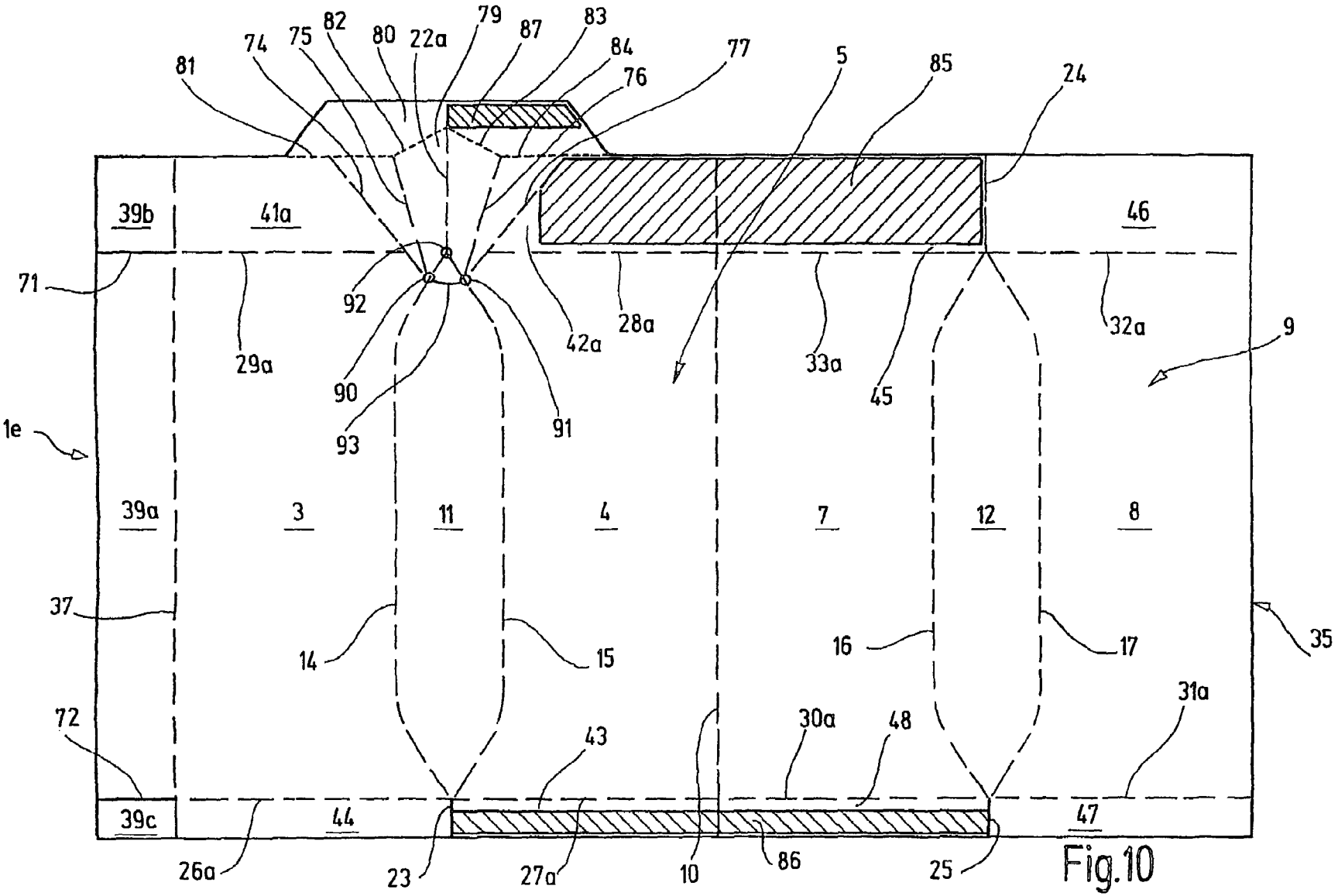
FIG. 10 shows a top view onto a blank for a folded box according to a sixth embodiment with an outlet funnel.

The embodiments shown in FIGS. 8, 9 and 10, resemble the embodiment of FIG. 1. Identical parts have identical reference numerals such that reference is made to the description of FIG. 1. Only the differences between the individual embodiments are mentioned below.

In the embodiment shown in FIG. 8, the closure folding lines 26' to 33' are slightly curved to the inside. The slight curvature results in that the distance between the closure folding lines 26' to 29' and the associated outer edge of the respective closing section is not constant but decreases to the tips of the side wall section 11. The same is true for the closure folding lines 30' to 33'. This course of the closure folding lines 26' to 33' obtains that the width of the closing sections 41 to 44 and 45 to 48 decreases towards the terminating folding lines 22, 23 or 24, 25.

In the embodiment shown in FIG. 9, the closure folding lines 26" to 33" are not slightly curved but straight. The distance between the closure folding lines 29" to 33" and the associated edge of the respective closing sections decreases towards the associated tips of the respective side wall sections 11, 12 as shown in the embodiment of FIG. 8. The width of the closing sections 41 to 48 is thereby decreased towards the respective terminating folding lines 22 to 25.

In the embodiment shown in FIG. 10, the distance between the closure folding lines 26*a* to 33*a* and the associated edge of the respective closure sections is constant. Therefore, the closing sections have a constant width. For closing, the closing sections 42*a*, 43, 45 and 48 have adhesive surfaces 85 and 86. The adhesive surfaces 85 and 86 serve to glue the closing sections which come into abutment when the erected folded box is closed. Gluing of the abutting closing sections permits a guarantee closure of the inventive folded box.

The corresponding closing sections may be sealed to each other instead of glued. For sealing, a lacquer to be applied to the closing sections is heated, wherein the closing sections are held in mutual abutment by means of pressure jaws. In a subsequent cooling process, the closing sections are permanently joined.

Two outlet funnel folding lines 74 and 75 are formed in the closing section 41*a*. The outlet funnel folding lines 74 and 75 intersect in a point 90 which is disposed on the side wall folding line 14 slightly separated from the tapering end 92 of the side wall section 11. The outlet funnel folding line 75 is disposed at a more acute angle to the terminating folding line 22*a* which forms a further outlet funnel folding line, than the outlet funnel folding line 74.

The outlet funnel folding lines 76 and 77 are axially symmetrical to the outlet funnel folding lines 75, 74 relative to the terminating folding line 22*a* or outlet folding line. The outlet funnel folding lines 76 and 77 intersect at a point 91 which is disposed at the same level of the side wall section 11 as the point of intersection 90 of the outlet funnel folding lines 74 and 75.

The points of intersection 90 and 91 are connected to each other via an outlet funnel folding line 93 which is slightly curved away from the tapering end 92. The outlet funnel folding line 93 increases the opening cross-section of the outlet funnel.

A triangular projection 79 joins the region of the closing sections 41*a* disposed between the outlet funnel folding lines 75 and 76. This triangular projection 79 forms an outlet channel when the outlet funnel is opened.

A closing flap 80 joins the closing sections 41*a*, 42*a* and the triangular projection 79. The closing flap 80 is connected via perforated lines 81, 82, 83 and 84 to the closing sections 41*a*, 42*a* and the triangular projection 79. An adhesive surface 87 is formed on the closing flap 80, which connects the two halves of the closing flap 80, formed by the terminating folding line 22*a* when the outlet funnel is closed. For opening the outlet funnel, the closing flap 80 must be torn off. The outlet funnel can then be opened by moving the outlet funnel folding lines 75 and 76 away from each other.

Figure 11:
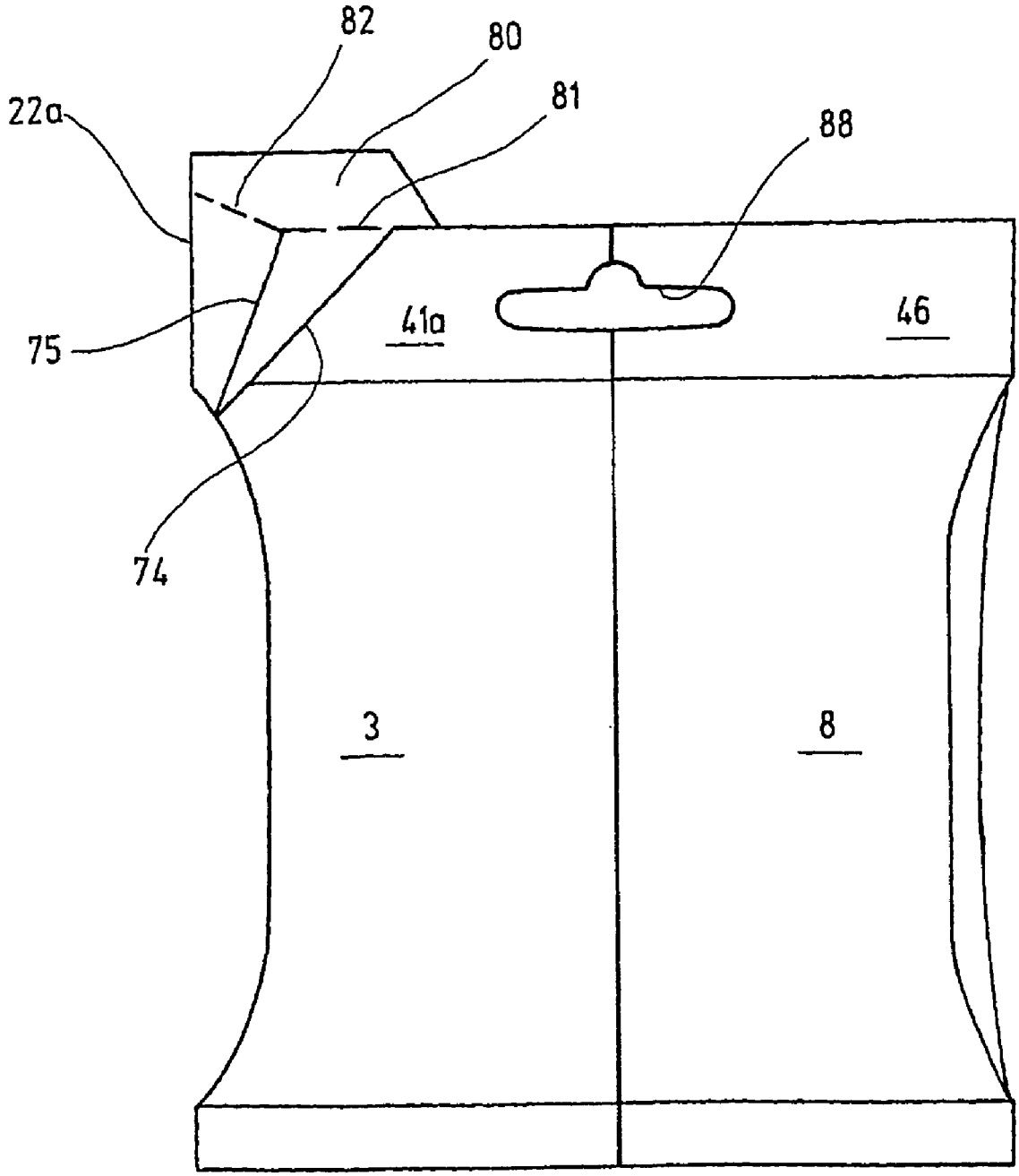
FIG. 11 shows a perspective view of an erected folded box with an outlet funnel as shown in the blank of FIG. 10.

FIG. 11 shows a perspective view of an erected folded box from a blank similar to the blank of FIG. 10. The closing sections 41*a* and 46 have a recess 88 in the form of a so-called Euro hole.

Figure 12:
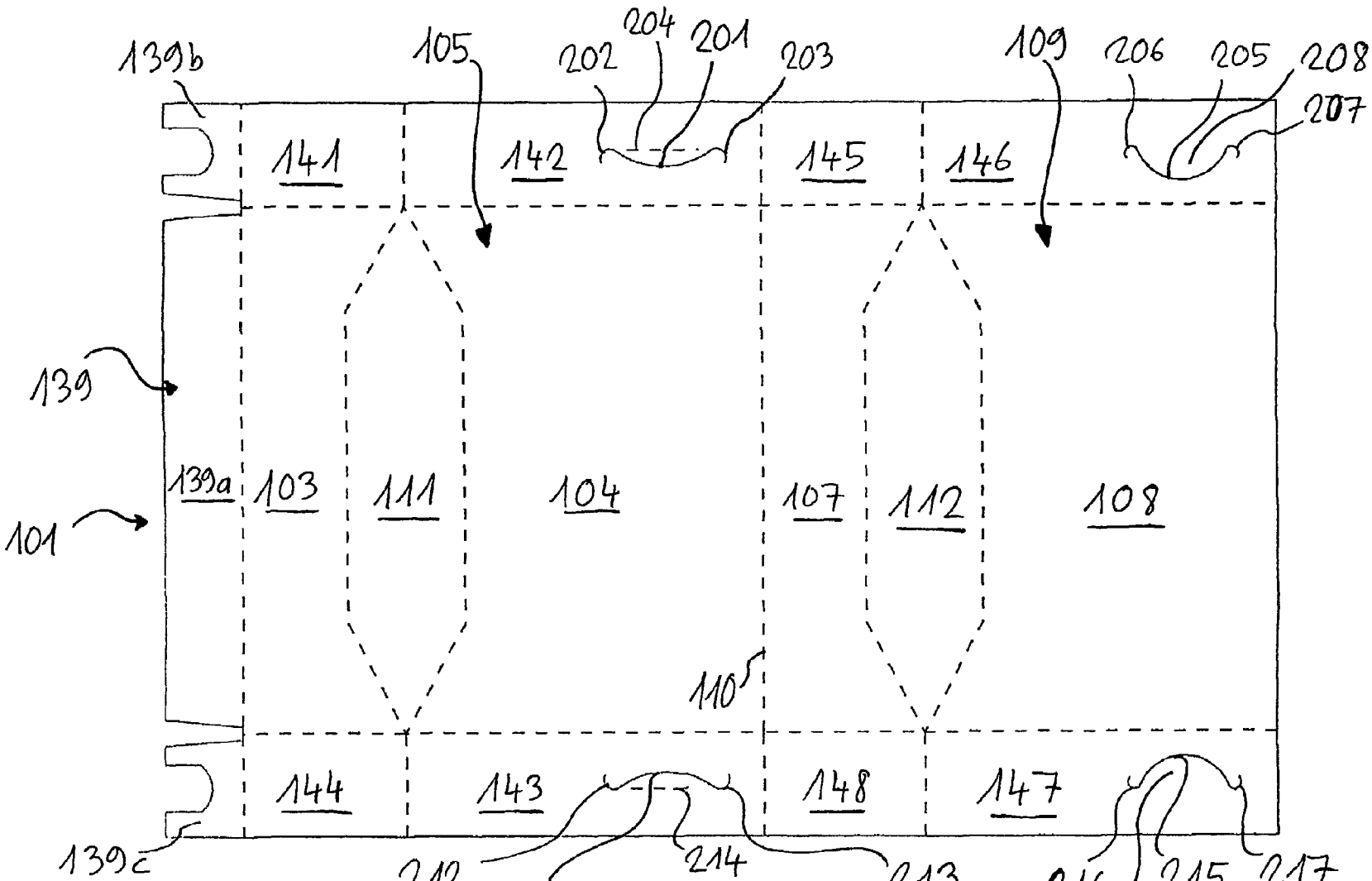
FIG. 12 shows a blank for a folded box according to a seventh embodiment with a closing flap.

FIG. 12 shows a blank similar to the blank of FIG. 1. Identical parts have the same reference numerals plus 100 such that reference is made to the description of FIG. 1. In the following, only the differences between the individual embodiments are mentioned. The flap 139 comprises in the embodiment shown in FIG. 12 three separate flaps 139*a*, 139*b* and 139*c* which have different designs. The flap 139*a* is based on a partial section 103 and has the shape of a longitudinal rectangle which has two inclined sides. The flaps 139*b* and 139*c* are each based on the associated closing section 141 and 144 and have the shape of rectangles with one inclined side and a U-shaped section.

Moreover, in the embodiment of FIG. 12, a circular arc-shaped cut 201, 211 is provided in the closing sections 142 and 143 which is curved towards the associated partial section 104. The ends 202, 203 and 212, 213 of the cuts 201 and 211 are also curved in a circular arc shape but in opposite directions to the associated cut. Moreover, the closing sections 146 and 147 have circular cuts 205 and 215 which are curved towards the associated partial section 108. The curvature of the cuts 205 and 215 is slightly stronger than the curvature of the cuts 201 and 211. The ends 206, 207 and 216, 217 of the cuts 205 and 215 are also curved in the shape of a circular arc but in the opposite direction to the cuts 205 and 215.

The cuts 205 and 215 form flaps 208 and 218 whose contour is more curved than the cuts 201 and 211. This ensures that the flaps 208 and 218 can engage well in the cuts 210 and 211 when the closing sections 142 and 146 or 143 and 147 come into abutment. Folding lines 204 and 214 which extend straight between the ends of the cuts 201 and 211 ensure easy opening of the cuts 201 and 211.

Figure 13:
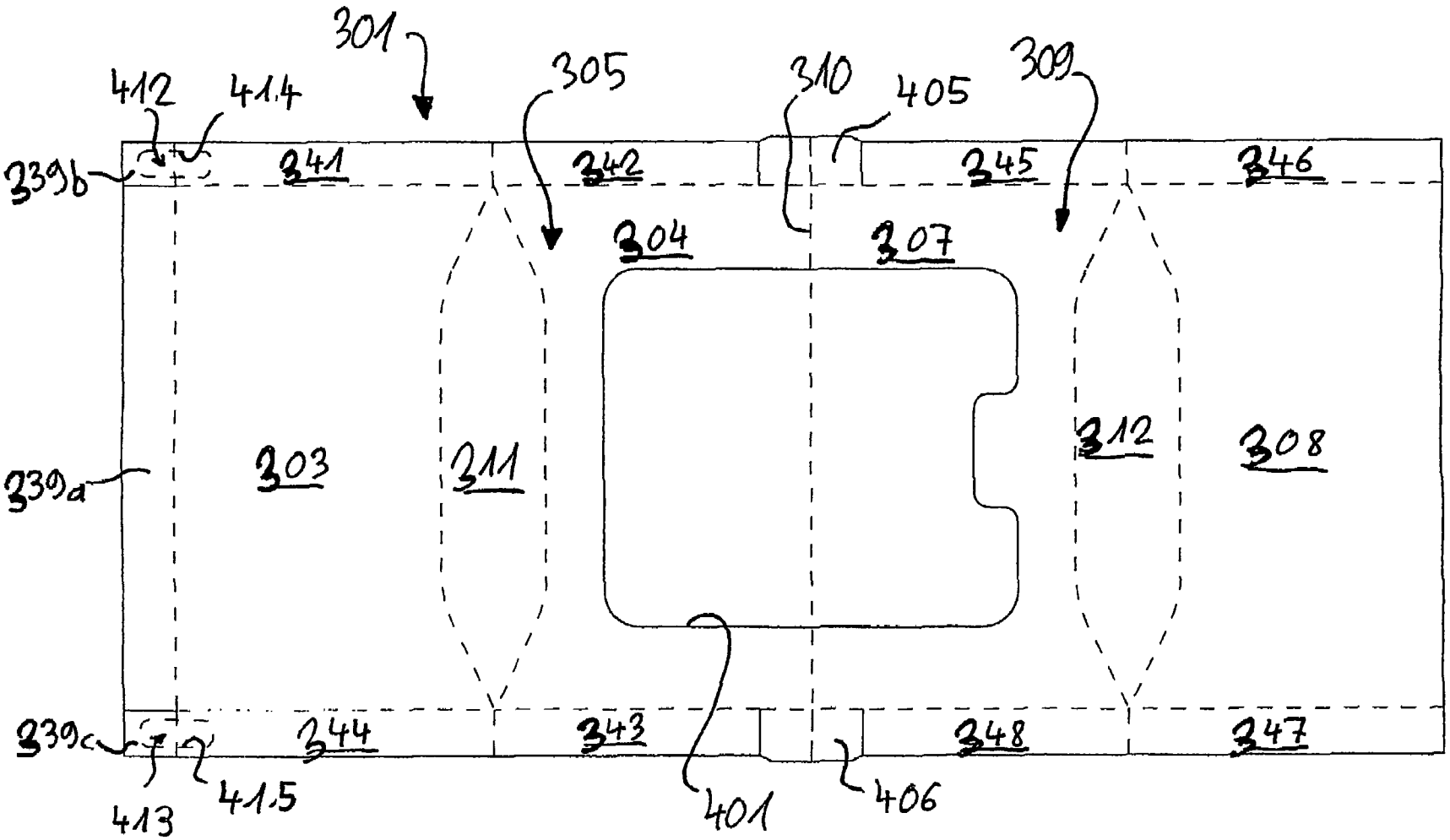
FIG. 13 shows a blank for a folded box according to an eighth embodiment with an original seal.

FIG. 13 shows a blank which is similar to the blank of FIG. 1. Identical parts have the same reference numerals plus 300 such that reference is made to the description of FIG. 1. Only the differences between the individual embodiments are described below.

In the embodiment shown in FIG. 13, the partial sections 304 and 307 have a common window 401 which can be filled or backed with a transparent plastic foil. The window 401 serves to make the content of the erected folded box visible from the outside.

In the region of the point of intersection between the closing sections 342 and 345, a flap 405 is cut out which is connected to the principal wall section 305 via a folding line. In the same way, a disposed flap 406 is cut out between the closing sections 343 and 348 which is also connected to the main wall section 305 via a folding line. The flaps 405 and 406 come in abutment on adhesive layers 412 and 413 provided in the connecting region between the flap 339*b* and the closing section 241 and the flap 339*c* and the closing section 344, when the folded box is erected. The adhesive surfaces 412 and 413 are delimited by grooves 414 and 415 which extend only in the upper layer of the blank 301.

When the flaps 405 and 406 abut on the associated adhesive surfaces 412 and 413 after erection of the folded box, the folded box is originally sealed. When the flaps 405 and 406 are folded, the upper layers of the blank 301 adhere to the flaps 405 and 406 within the grooves 414 and 415 together with the adhesive layers 412 and 413. Renewed closing of the folded boxes with the flaps 405 and 406 is no longer possible.

The coinciding design of the closing sections provides among other thing the advantage that a plurality of in particular simple sealing possibilities can be applied. The closing sections can also be designed having different functions e.g. as Euro hole, pouring means, apportioning means or handles. The closing sections can also be provided with a decorative contour punching.

The inventive folded box combines the advantages of a plurality of closing possibilities, simple production, simple handling and reduced machine and tool costs in all regions. It also offers a plurality of possible applications and is suited for package anything.

The transition from the package body to the closing sections may be formed by a displaced or curved line whereby tension is generated in the erected state through which the closing sections are held in mutual abutment. Simple manual securing is possible through two circular arc-shaped cuts.

For presents, simple geometrical shapes can be punched out in the closing sections through which e.g. a cord or ribbon can be guided to close the folded box.

An original seal may be provided by connecting the abutting closing sections mechanically to each other by a hot setting adhesion point. This ensures that opening of the package will always damage it to prevent undesired manipulation and theft of the contents of the packing.

When the closing sections are rigidly connected by sealing, even liquid media can be kept in the erected folded box. The material of the blank must, of course, be suitable for accommodating the liquid or be provided with a corresponding coating.

It is pointed out that the principal folding line 10 and/or the terminating folding line 37 may be omitted in all embodiments depending on the production method.

I claim:

1. A rectangular, one-piece blank (1) adapted to form a flat folded box, the folded box being manually erectable into a substantially tubular box with its ends being closed automatically, the blank comprising:

two principal wall sections (5, 9) which are connected to each other on one side by a principal folding line (10), two side wall sections (11, 12) with tapering ends formed each in a respective one of the two principal wall sections (5, 9) by two folding lines (14, 15; 16, 17) which are separated from each other in the center and merge into each other at their ends, the two side wall sections (11, 12) being identical in shape and being each symmetrical with respect to a center line defined by the tapering ends of each side wall section (11, 12), two closing sections (41, 42, 45, 46; 43, 44, 47, 48) connected each to the principal wall sections (5, 9) by a continuous closure folding line (28, 29, 32, 33; 26, 27, 30, 31) which is disposed substantially transversely to the principal folding line (10), wherein the two folding lines of each sidewall section (14, 15; 16, 17) merge at the closure folding lines (28, 29, 32, 33; 26, 27, 30, 31) into two terminating folding lines (22, 23, 24, 25) each extending in a respective one of the closing sections (41, 42, 45, 46; 43, 44, 47, 48) parallel to the principal folding line (10) and wherein no further transverse folding lines are provided between the two closure folding lines (28, 29, 32, 33; 26, 27, 30, 31), and a flap (39) connected to the side of one (5) of the principal wall sections (5, 9) by a further terminating folding line (37) which is parallel to the principal folding line (10), wherein the principal folding line (10) and the further terminating folding line (37) each extend in the closing sections (41, 42, 45, 46; 43, 44, 47, 48) and wherein the principal folding line (10), the two folding lines (14, 15; 16, 17) and the further terminating folding line (37) are disposed such that when the two principal wall sections (5, 9) are folded onto each other along the principal folding line (10), the further terminating folding line (37) coincides with an edge (35) of the opposite principal wall section (9) and the two side wall sections (11, 12) are lying onto each other and that in the assembled state of the flat folded box ends of the folded box formed by the two closing sections (41, 42, 45, 46; 43, 44, 47, 48) are automatically closed by pressing the principal folding line (10) and the further terminating folding line (37) together.

2. Blank according to claim 1, wherein the two folding lines forming the side wall sections are disposed parallel to each other in the central region.

3. Blank according to claim 1, wherein the ends of the side wall sections are triangular.

4. Blank according to claim 1, wherein the side wall sections have an elliptical shape.

5. Blank according to claim 1, wherein the width of each closing section in the direction parallel to its terminating folding lines is not constant but varies.

6. Blank according to claim 5, wherein the width of each closing section increases from each terminating folding line to both sides of the terminating folding line.

7. Blank according to claim 6, wherein the width of each closing section increases linearly from each terminating folding line to both sides of the terminating folding line.

8. Blank according to claim 6, wherein the closure folding lines comprise circular arcs, curved to the side wall section of the associated principal wall section.

9. Blank according to claim 1, wherein the width of each closing section in the direction parallel to its terminating folding lines is constant between the two termination folding lines and increases from each terminating folding line to both sides of the terminating folding lines.

10. Blank according to claim 1, wherein an outlet funnel is formed on one of the tapering ends of one of the side wall sections.

11. Blank according to claim 10, wherein the outlet funnel is formed by means of at least five outlet funnel folding lines which are formed in the closing sections disposed on the tapering end of the side wall section.

12. Blank according to claim 11, wherein the distance between the outlet funnel folding lines decreases towards the associated tapering end of the side wall section.

13. Blank according to claim 12, wherein in the region of the outlet funnel on the associated closing sections a triangular projection is disposed with the tip to this outside.

14. Blank according to claim 13, wherein a closing flap is provided outside on the outlet funnel which can be separated from the two bordering closing sections by at least one perforated line.

15. Blank according to claim 1, wherein in at least one of the closing sections a cut is provided in which a flap can engage, which is formed on the closing section which comes into abutment with the closing section with the cut when the folded box is erected.

16. Blank according to claim 15, wherein the cut has the shape of an inwardly curved circular arc, relative to the blank.

17. Blank according to claim 16, wherein the flap is formed by a cut which has the shape of a circular arc, which is curved to the inside relative to the blank.

18. Blank according to claim 1, wherein in at least one closing section at least one flap is formed which comes into abutment with an adhesive surface when the folded box is erected, which is formed on an abutting closing section and is covered by the flap.

19. Blank according to claim 18, wherein the adhesive surface is delimited by a grove.

* * * * *